US005549379A

United States Patent [19]

Jun et al.

[11] Patent Number: 5,549,379

[45] Date of Patent: Aug. 27, 1996

[54] SHELF DEVICE FOR A REFRIGERATOR

[75] Inventors: Gun S. Jun; Sang Y. Lee, both of Changwon-si, Rep. of Korea

[73] Assignee: Goldstar Co., Ltd., Seoul, Rep. of Korea

[21] Appl. No.: 100,215

[22] Filed: Aug. 2, 1993

[51] Int. Cl.[6] ..... A47B 96/06

[52] U.S. Cl. ..... 312/408; 312/246; 211/94

[58] Field of Search ..... 312/408, 246; 211/94, 88

[56] References Cited

U.S. PATENT DOCUMENTS

| | | | |
|---|---|---|---|
| 3,401,997 | 9/1968 | Hanifan | 312/408 X |
| 4,131,203 | 12/1978 | Bridges | 211/88 |
| 4,457,436 | 7/1984 | Kelley | 211/88 |
| 4,515,421 | 5/1985 | Steffes | 312/408 X |
| 4,711,419 | 12/1987 | Polosky | 211/94 X |
| 4,828,120 | 5/1989 | Beil et al. | 211/88 |
| 5,004,302 | 4/1991 | Stocking et al. | 312/408 |
| 5,228,579 | 7/1993 | Kaufman | 211/94 |
| 5,403,083 | 4/1995 | Dasher et al. | 312/408 |

FOREIGN PATENT DOCUMENTS

| | | | |
|---|---|---|---|
| 363868 | 4/1990 | European Pat. Off. | 312/246 |

*Primary Examiner*—Peter M. Cuomo
*Assistant Examiner*—David E. Allred
*Attorney, Agent, or Firm*—Fish & Richardson PC

[57] ABSTRACT

A shelf device for a refrigerator comprising a bracket or a guide rail horizontally mounted on a back wall of a refrigerating chamber, and a shelf assembly coupled to the bracket or the guide rail so that a user can horizontally displace or slide the assembly to a desired position depending upon a size of an object to be stored.

3 Claims, 6 Drawing Sheets

SHELF DEVICE FOR A REFRIGERATOR

BACKGROUND OF THE INVENTION

1. Field of the Invention

This invention relates to a shelf device for a refrigerator, and more particularly a shelf device for a refrigerator, which comprises a shelf assembly mounted in a refrigerating chamber of the refrigerator and movable horizontally so that a user can horizontally move it depending upon the size of a foodstuff to be stored, thereby efficiently utilizing the internal space of the refrigerator.

2. Description of the Prior Art

There have been heretofore proposed shelf devices of various forms and designs, a typical example of which is of the type shown in FIGS. 1 and 2 of the accompanying drawings, which comprises a pair of support bars 1 each formed with a row of vertically spaced, elongated holes 1*a* and vertically fixed to a back wall surface of a refrigerating chamber of a refrigerator, and a shelf assembly 3 including a shelf frame 2 formed with two pairs of downwardly bent hooks 2*a* which are engaged with the elongated holes 1*a* of the support bars 1.

This prior shelf device is however disadvantageous in that while the device allows foodstuffs to be stored in the refrigerating chamber through slight adjustment of the level of each shelf assembly 3 in the range of the elongated holes 1*a* formed in the support bars 1, larger objects such as a larger container, a bulky watermelon and the like, for example, must be stored in the chamber with any of the shelf assemblies 3 removed, requiring complicated removal work and custody of the removed shelf assembly, thereby giving inconvenience to a user.

SUMMARY OF THE INVENTION

With the foregoing problem of the prior art device in view, it is an object of the present invention to provide a shelf device for a refrigerator, which comprises a shelf assembly constructed to be movable horizontally, not vertically, so that a user can horizontally move it depending upon a storage state of a bulky foodstuff in the refrigerator.

To achieve the above object, there is provided according to one form of the present invention a shelf device for a refrigerator comprising a bracket horizontally mounted on a back wall of a refrigerating chamber; a plurality of engaging holes formed in the bracket in equally spaced relation to one another; and a shelf assembly having a length less than the width of the refrigerating chamber and provided with hooks engaged with the engaging holes; whereby a user can horizontally move the shelf assembly depending upon the size of an object to be stored.

According to another form of the present invention, there is provided a shelf device for a refrigerator comprising a box type bracket having an upwardly projecting piece and horizontally mounted on a back wall of a refrigerating chamber; and a shelf assembly provided with an engaging piece hooked on the projecting piece of the bracket and a guide groove brought into contact with the bracket; whereby the shelf assembly can be slidingly displaced without being dismounted from the bracket.

According to further form of the present invention, there is provided a shelf device for a refrigerator comprising a guide rail horizontally mounted on a back wall of a refrigerating chamber; sliders movable along the guide rail; and a shelf assembly connected to the sliders to be horizontally movable therewith along the guide rail and having a length less than the width of the refrigerating chamber; whereby a user can displace more conveniently the shelf assembly through a smooth sliding movement thereof.

DESCRIPTION OF THE PREFERRED EMBODIMENT

The invention will now be described in more detail with reference to FIGS. 3 to 10 of the accompanying drawings, which illustrate preferred embodiments thereof.

Figure 1:
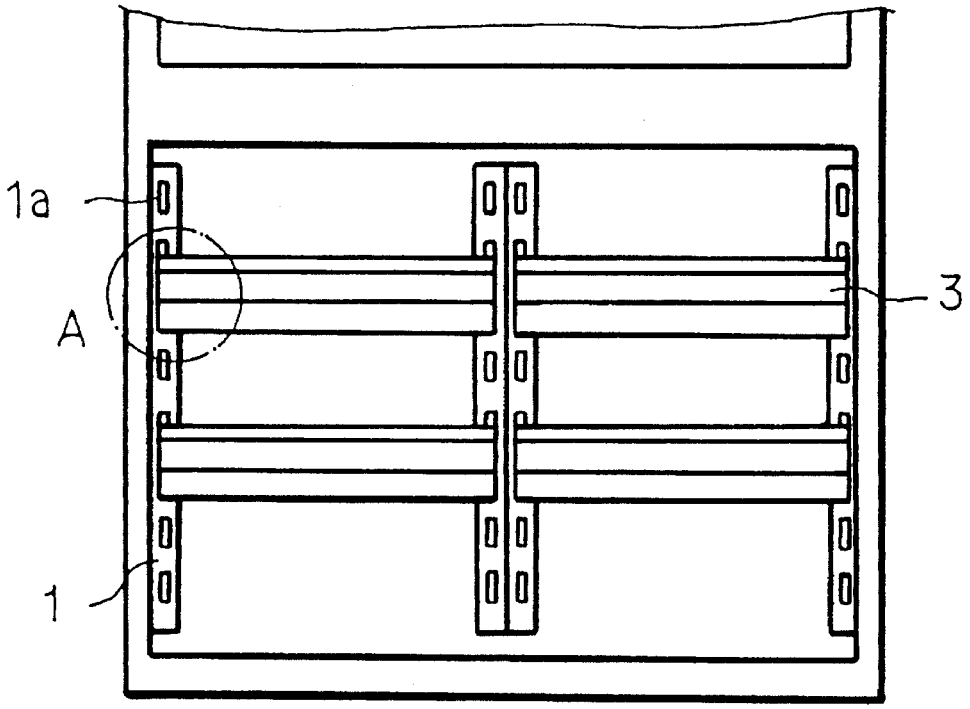
FIG. 1 PRIOR ART
FIG. 1 is a front view of a refrigerating chamber of a refrigerator with shelf devices according to the prior art mounted therein.
Figure 2:
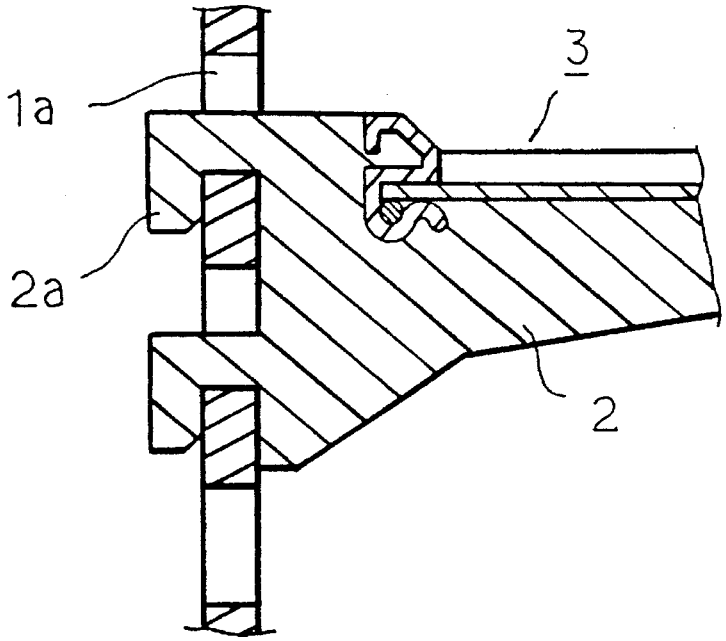
FIG. 2 PRIOR ART
FIG. 2 is an enlarged sectional view of area A in FIG. 1.
Figure 3:
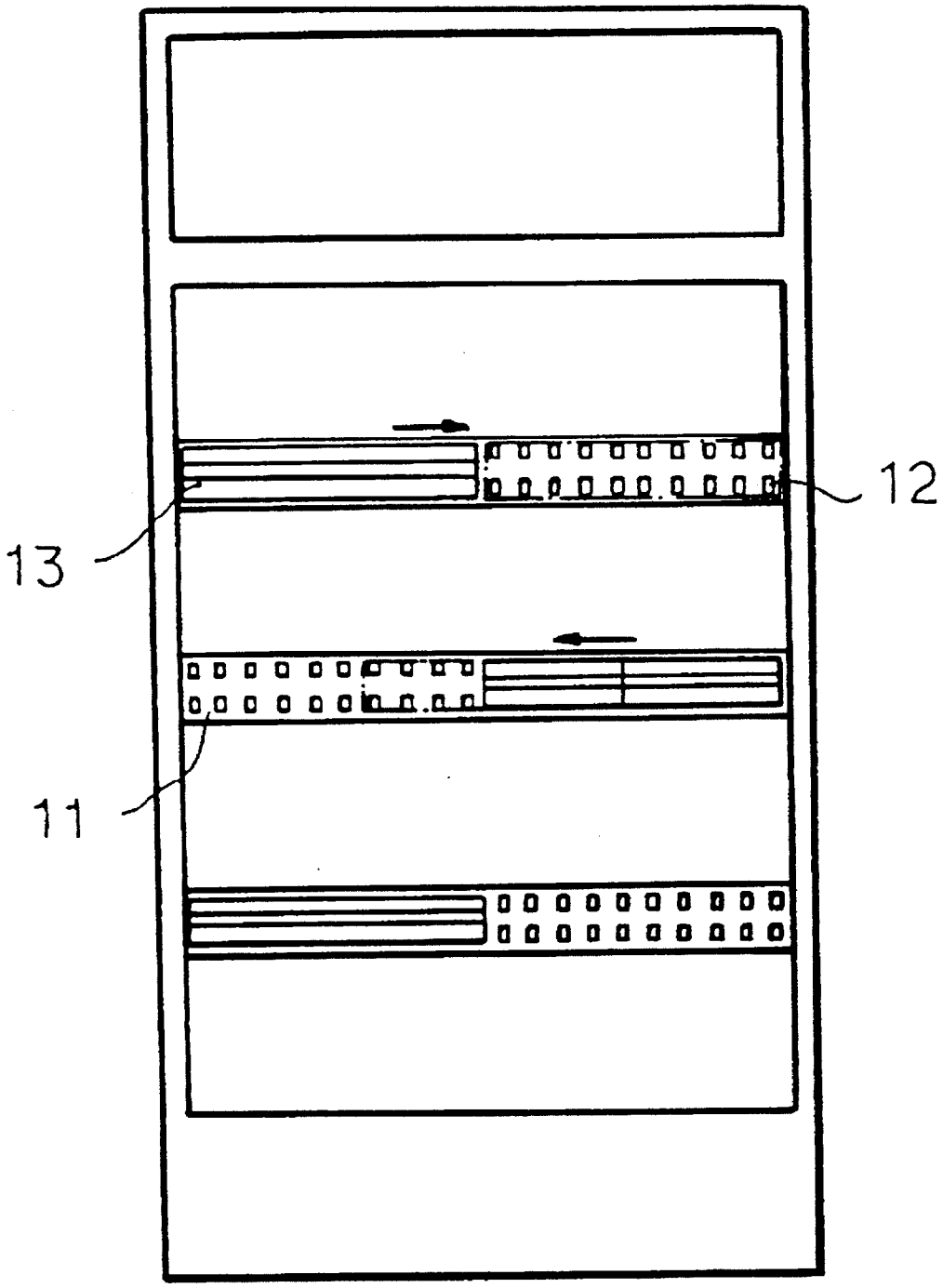
FIG. 3 is a front view of the refrigerating chamber with shelf devices according to the present invention mounted therein.
Figure 4:
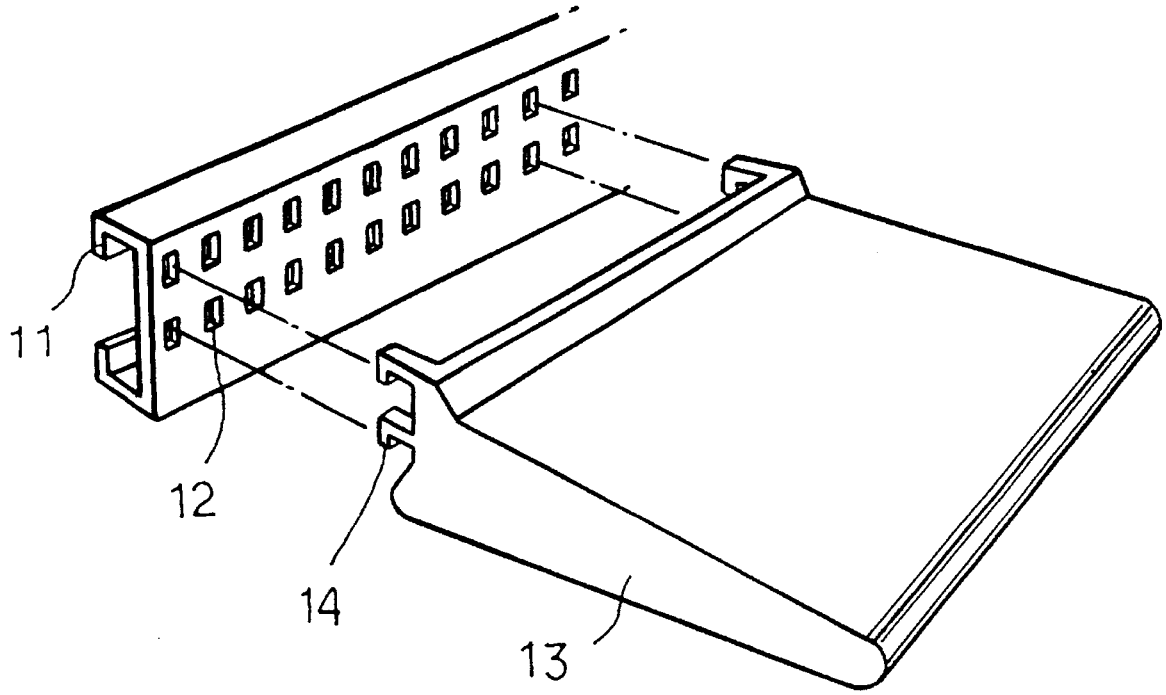
FIG. 4 is an exploded perspective view showing the important parts of the shelf device according to one embodiment of the present invention.
Figure 5:
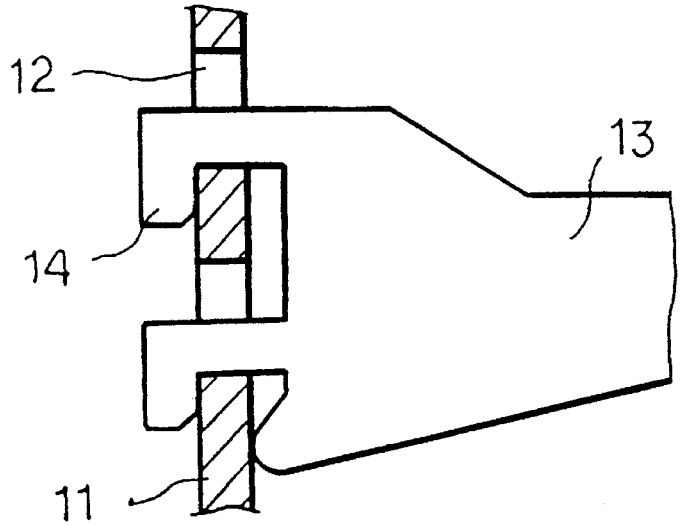
FIG. 5 is a cross-sectional view showing the parts of FIG. 4 in an assembled state.

FIG. 3 is a front view of refrigerating chamber of a refrigerator with shelf devices according to the present invention mounted therein, FIG. 4 shows in exploded perspective view the important parts of the shelf device according to one embodiment of the present invention, and FIG. 5 shows in section the parts of FIG. 4 in an assembled state.

The shelf device according to one embodiment of the present invention comprises a bracket 11 horizontally fixed to the back wall of the refrigerating chamber and having a plurality of horizontally spaced, rectangular engaging holes 12 formed therein in two rows, and a shelf assembly 13 having two pairs of downwardly bent hooks 14 having one pair at each of both ends of its rear side to be engaged with the engaging holes 12 of the bracket 11 at a desired mounting position.

As shown in FIG. 3, a plurality of such brackets 11 are horizontally mounted on the back wall of the refrigerating chamber in vertically spaced relation to one another, diffenently from the support bars of the prior art vertically mounted in a laterally spaced relation to one another, and the shelf assembly 13 is mounted on each bracket 11 at a desired position through engagement of the hooks 14 with the selected holes of the engaging holes 12 of the bracket in such a manner that the shelf assembly may be varied in position depending upon the storage state of a foodstuff in the refrigerator.

As shown in FIG. 4, the shelf assembly 13 may be selectively positioned by engaging two pairs of the hooks 14 formed at both ends of the rear side of the assembly with two pairs of the upper and lower engaging holes 12 of the bracket 11. The engaged state of the hooks of the shelf assembly with the holes of the bracket is shown in section in FIG. 5. Preferably, the shelf assembly 13 has an appropriate length less than the width of the refrigerating chamber.

With this construction, an optimal storage state in the chamber may be simply and conveniently accomplished depending upon a desired storage condition, so that larger objects may be conveniently stored in the refrigerating chamber simply by displacing horizontally any of the shelf assemblies according to a size of the object to be stored, without removing and separately keeping the shelf assembly as in the prior art.

Figure 6:
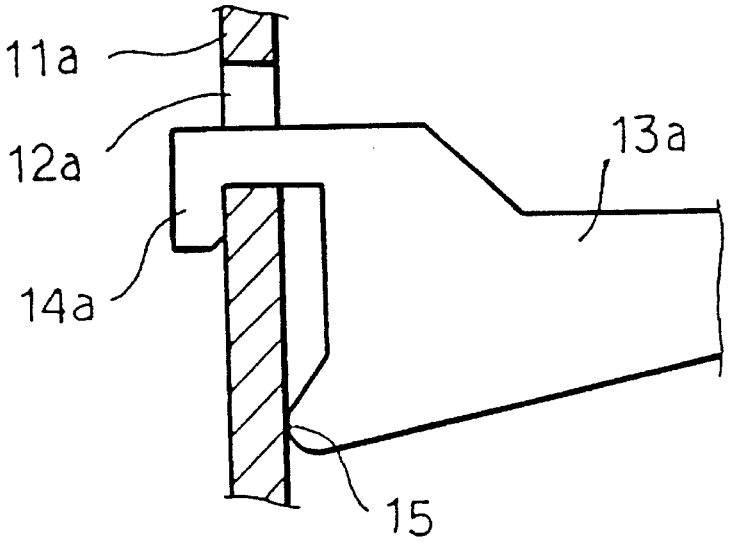
FIG. 6 is a cross-sectional view of a portion of the shelf device according to another embodiment of the present invention.

According to another embodiment of the present invention shown in FIG. 6, the shelf device comprises a bracket 11*a* having a plurality of equally spaced engaging holes 12*a* formed therein in a row, instead of two upper and lower rows as in the embodiment shown in FIG. 4, and a shelf assembly 13*a* provided at each end of its rear side with only one hook 14*a* engaged with one of the holes 12*a* of the single row and a support surface 15 projectingly formed below the hook 14*a* to be brought into contact with the solid surface of the bracket 11*a*.

The provision for the single hook 14*a* engaged with one hole 12*a* of the bracket 11*a* facilitates displacement of the shelf assembly 13*a* as compared with the embodiment shown in FIG. 5. In an assembled state, the shelf assembly of this embodiment can be kept in place by its own gravity and weight and that of the supported object without play.

Figure 7:
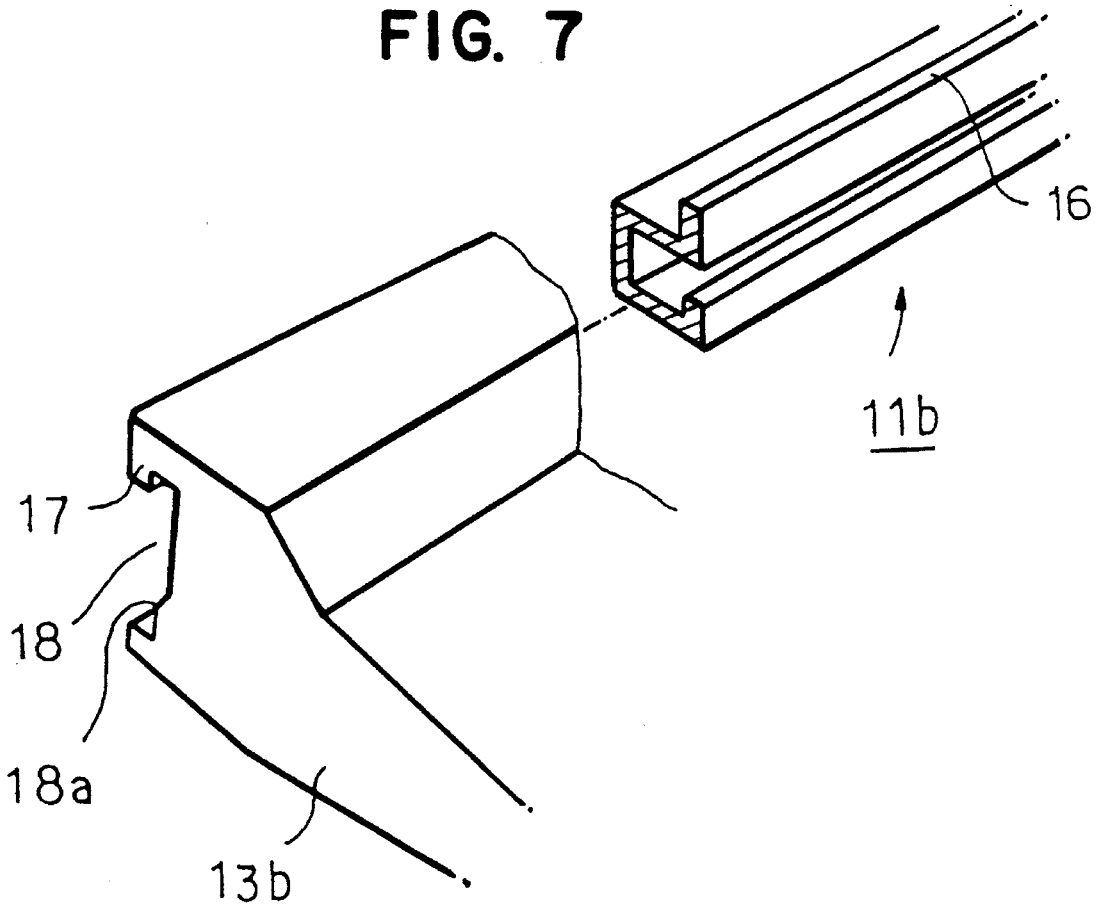
FIG. 7 is a fragmentary perspective view of the shelf device according to a further embodiment of the present invention.

According to further another embodiment of the present invention, the bracket comprises engaging means permitting a change in position of the shelf assembly to be easily carried out, instead of the engaging holes as in the previous embodiments. As shown in FIG. 7, the shelf device of this embodiment comprises a bracket 11*b* of a generally square tube configuration horizontally mounted on the back wall of the refrigerating chamber and having a projecting piece 16 protruding upwardly from its upper surface, and a shelf assembly 13*b* provided with an engaging piece 17 hooked on the projecting piece 16 and a guide groove 18 formed longitudinally in the rear side thereof.

With this construction, the shelf assembly 13*b* can be displaced simply by sliding it to a desired position along the bracket 11*b* without separating it from the bracket. In this case, preferably, the guide groove 18 may be formed with a projecting surface 18*a* serving to ensure smooth sliding movement of the assembly 13*b* on the bracket 11*b* and support load of the supported objects through its contact with the front surface of the bracket 11*b*.

Still further another embodiment of the present invention, in which the shelf assembly is constructed to be capable of being slid easily even when the objects are supported thereon, will now be explained with reference to FIGS. 8 to 10.

Figure 8:
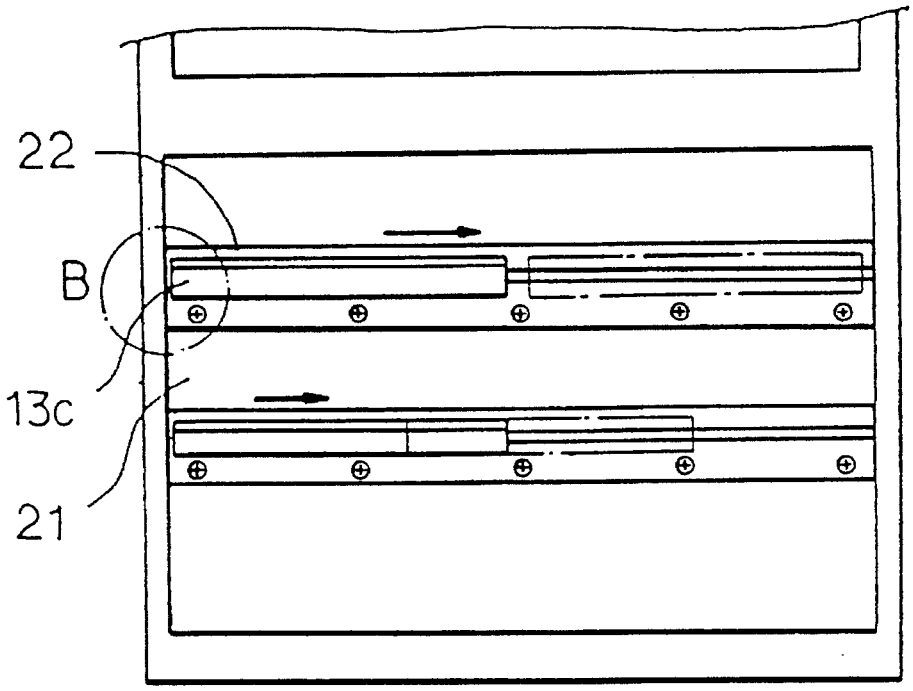
FIG. 8 is a front view of the refrigerating chamber with the shelf devices according to still a further embodiment of the present invention mounted therein.

Referring to FIG. 8 showing a front view of the refrigerating chamber with the shelf device according to this embodiment mounted therein, the shelf device comprises a guide rail 22 horizontally fixed on the back wall 21 of the chamber and a shelf assembly 13*c* connected to the guide rail 22 to be movable along the rail. The shelf assembly 13*c* includes a shelf frame 24 and a glass plate 26 supported by support rods 25 caulked in the shelf frame and a rear cover 27. The glass plate may be replaced by a plate of any other material or a wire grid.

Figure 9:
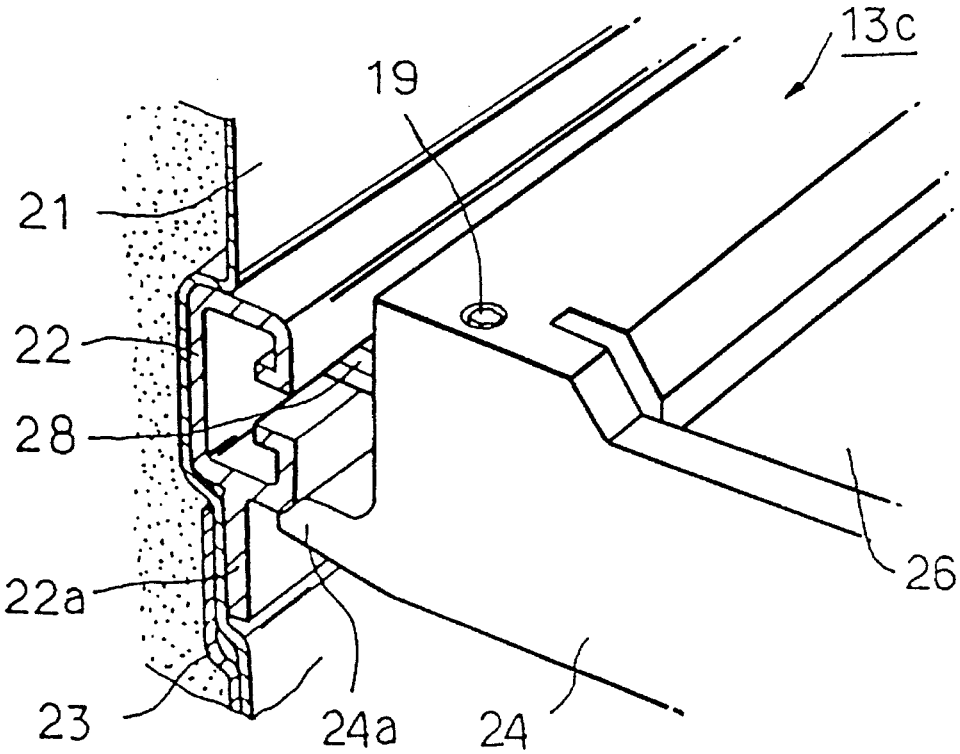
FIG. 9 is a fragmentary perspective view of area B in FIG. 8.
Figure 10:
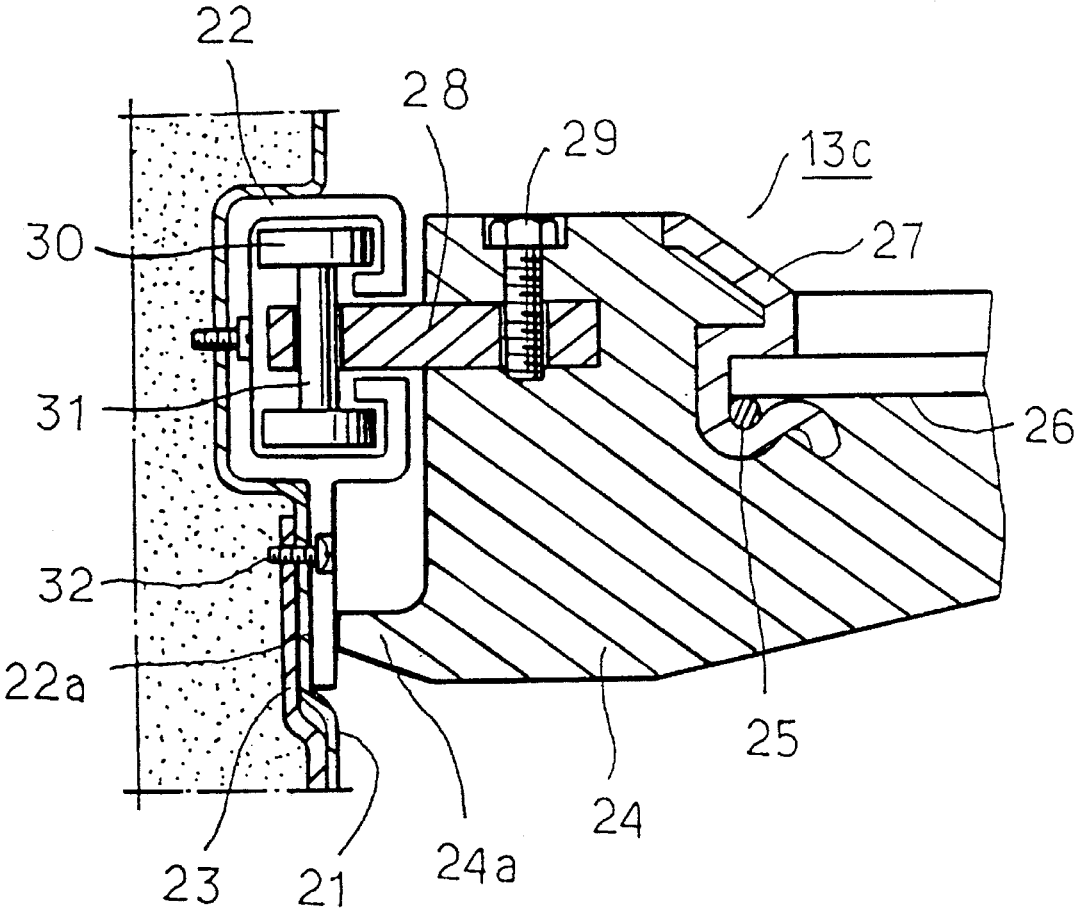
FIG. 10 is a cross-sectional view of the shelf device shown in FIG. 9.

Each of sliders for slidingly connecting the shelf assembly to the guide rail comprises, as shown in FIGS. 9 and 10, a support bar 28 secured to the rear end portion of the shelf frame 24 by means of a bolt 29, and a pair of rollers 30 rotatably mounted at one end of the support bar 28 via a support shaft 31 and disposed to come into rolling contact with the inner surface of the guide rail 22, whereby the shelf assembly 13*c* can be moved along the guide rail.

In addition, the guide rail 22 has an integral connection piece 22*a* depending downwardly from its underside, and the shelf frame 24 has a horizontally projecting piece 24*a* formed at the lower portion of its rear side. Therefore, at a rest position, the shelf assembly 13 may be horizontally kept by engagement of the projecting piece 24*a* with the connection piece 22*a*. The reason for forming the connection piece 22*a* integral with the guide rail 22 is to help the protruding piece 24*a* to support load applied to the shelf assembly by the foodstuffs placed thereon.

Reference Numeral 32 denotes screws for fastening the guide rail 22 to the back wall 21, and 23 denotes a reinforcing piece for improving fastened strength of the guide rail.

The operation and effect of the thus constructed device of this embodiment will now be explained. First, when the shelf assembly 13*c* has been mounted on the guide rail 22, as shown in FIG. 10, the shelf assembly is kept in a horizontal state by engagement of the projecting pieces 24*a* with the connection piece 22*a*, so that foodstuffs can be placed on the assembly to be stored in the refrigerating chamber.

In this state, when it is desired to displace the shelf assembly 13*c* according to the size of the foodstuff to be put into the chamber, since it may be difficult to slide the shelf assembly due to the tight engagement of the projecting piece 24*a*, supporting the load of the foodstuffs on the assembly, with the connection piece 22*a*, a user slightly lifts up the forward end of the assembly to bring the projecting piece out of engagement with the connection piece, and then slides the assembly to a desired position. At this time, the rollers 30 connected to the support bar 28 via the support shaft 31 execute rolling movement on the inner surface of the guide rail 22, so that the shelf assembly can be displaced easily along the guide rail.

Therefore, when storing a lengthy object in a vertically oriented posture, the object can be conveniently put into the refrigerating chamber laterally displacing the shelf assembly in accordance with the length of the object to secure a necessary space.

From the foregoing it will be appreciated that the present invention provides advantages over the prior art in that the shelf assembly can be adjusted in position depending upon the height of a foodstuff to be stored without removing and separately keeping the shelf assembly, so that the refrigerator can be used more conveniently, and in that the available space of the refrigerating chamber can be easily varied according to a desired storage state of the foodstuff, so the utility of the storage space may be maximized.

While the invention has been shown and described with particular reference to various embodiments thereof, it will be understood that variations and modifications in form and detail may be made therein without departing from the spirit and scope of the invention as defined in the appended claims.

What is claimed is:

1. A shelf device for a refrigerator comprising;

an elongated bracket having a projecting piece protruding upwardly from its upper surface over a substantial portion of its length and horizontally mounted on a back wall of a refrigerating chamber; and a shelf assembly provided with an elongated engaging piece extending along a majority of the length of said shelf assembly and hooked on said bracket projecting piece, said shelf assembly having a guide groove, said guide groove including a horizontal portion extending from said engaging piece, a vertical portion extending downwardly from said horizontal portion, and a projecting surface which extends at an angle from said vertical portion, said projecting surface providing contact along at least one line with said bracket over a major portion of the length of the shelf assembly and with no other contact between said shelf assembly and said bracket and no contact between said shelf assembly and said refrigeration wall, said shelf assembly being smoothly slidable horizontally along said bracket.

2. A shelf device for a refrigerator as claimed in claim 1, wherein said bracket has a rear wall extending downwardly from said upper surface and a lower horizontal wall extending forwardly from said rear wall, said lower horizontal wall extending forwardly and terminating in a front surface said guide groove projecting surface and said front surface abutting in said contact along said at least one line to ensure support of said shelf assembly and smooth sliding movement of said engaging piece on said shelf assembly horizontally along said bracket.

3. A shelf device for a refrigerator comprising;

an elongated guide rail horizontally mounted on a back wall of a refrigerating chamber;

at least one slider having an elongated hooking portion extending from a vertical portion, and which hooks to the guide rail over a major portion of the at least one slider length and having a contact bearing portion extending at an angle from said vertical portion and which is movable horizontally along said guide rail with contact along said at least one line between said contact bearing portion and said guide rail over a major portion of said length; and a shelf assembly of a length substantially equal to and coincident with that of said at least one slider connected to said at least one slider to be horizontally movable along said guide rail with the total area of contact between said at least one slider and said guide rail being limited to that of said hooking portion and said contact bearing portion with said guide rail and with no other contact of said at least one slider and said shelf assembly with said guide rail or said refrigerator wall.

* * * * *